US006091799A

United States Patent [19]

Schmidt

[11] Patent Number: 6,091,799

[45] Date of Patent: Jul. 18, 2000

[54] X-RAY TUBE WITH MEANS FOR MAGNETIC DEFLECTION

[75] Inventor: Roland Schmidt, Erlangen, Germany

[73] Assignee: Siemens Aktiengesellschaft, Munich, Germany

[21] Appl. No.: 09/119,965

[22] Filed: Jul. 21, 1998

[30] Foreign Application Priority Data

Jul. 24, 1997 [DE] Germany ..... 197 31 982

[51] Int. Cl.[7] ..... H01J 35/30

[52] U.S. Cl. ..... 378/137; 378/138; 378/113; 378/121; 378/119

[58] Field of Search ..... 378/137, 138, 378/113, 121

[56] References Cited

U.S. PATENT DOCUMENTS

| | | | |
|---|---|---|---|
| 5,313,510 | 5/1994 | Ebersberger et al. | 378/12 |
| 5,812,632 | 9/1998 | Schardt et al. | 378/137 |
| 5,822,395 | 10/1998 | Schardt et al. | 378/137 |
| 5,883,936 | 3/1999 | Hell et al. | 378/125 |
| 5,898,755 | 4/1999 | Meusel et al. | 378/137 |
| 5,909,479 | 6/1999 | Rother | 378/121 |

FOREIGN PATENT DOCUMENTS

| | | |
|---|---|---|
| 0 460 421 | 12/1991 | European Pat. Off. . |
| 41 25 926 | 8/1992 | Germany . |
| 2 021 310 | 11/1979 | United Kingdom . |

*Primary Examiner*—David V. Bruce
*Assistant Examiner*—Allen C Ho
*Attorney, Agent, or Firm*—Hill & Simpson

[57] ABSTRACT

An X-ray tube with a cathode and an anode arranged in a vacuum housing has an electromagnet for deflecting the electron beam emanating from the cathode and proceeding to the anode, the electromagnet having a yoke with two legs connected to one another by a base section, with a winding surrounding the base section. The base section with the winding is located outside the vacuum housing. The legs of the yoke of the electromagnet extend into the vacuum housing so that the electron beam proceeds between the two legs.

5 Claims, 3 Drawing Sheets

X-RAY TUBE WITH MEANS FOR MAGNETIC DEFLECTION

BACKGROUND OF THE INVENTION

1. Field of the Invention

The present invention is directed to an X-ray tube of the type having a cathode and an anode arranged in a vacuum housing, with an arrangement for magnetically deflecting the electron beam.

2. Description of the Prior Art

The possibility of deflecting the electron beam and the focal spot is of significance, particularly in computed tomography, since an improvement of the image quality can be achieved by the known measure of displacing the focal spot between two limit positions, thus doubling the data available for the calculation of the image of a body slice.

German OS 41 25 926 and European Application 0 460 421 disclose X-ray tubes of the type initially described.

In both of these known X-ray tubes, the arrangement for the deflection of the electron beam is formed by a deflection unit that is arranged outside the vacuum housing and includes a deflection coil. Arranging the deflection unit outside the vacuum housing yields the advantage that disadvantageous effects on the vacuum in the vacuum housing caused by the presence of the coil in the interior of the vacuum housing are avoided, for example the emission of gas by the insulation of the coil wire. Considerable electrical power must be supplied to the deflection units located outside the vacuum housing for effecting a specific deflection of the electron beam, so that an undesirably high amount of dissipated heat is released in conjunction with the deflection of the electron beam. This is a disadvantage in view of the thermal problems that already occur during operation of X-ray tubes.

SUMMARY OF THE INVENTION

An object of the present invention is to provide an X-ray tube of the type initially described wherein the dissipated heat arising in the deflection of the electron beam is reduced.

This object is inventively achieved in an X-ray tube having a cathode and an anode that are arranged in a vacuum housing, with an electromagnet provided for the deflection of the electron beam emanating from the cathode and proceeding to the anode, the electromagnet including a yoke with two legs connected to one another by a base section and a winding surrounding the base section, with the base section with the winding being located outside the vacuum housing, and the legs extending into the vacuum housing such that the electron beam proceeds between the two legs.

In the inventive X-ray tube, thus, the arrangement for the magnetic deflection of the electron beam is formed by an electromagnet of which only the legs of the yoke are accepted in the inside of the vacuum housing, whereas the winding is located outside the vacuum housing. Disadvantageous influences on the quality of the vacuum present in the inside of the vacuum housing are precluded in this way. Since the electron beam proceeds between the legs of the yoke of the electromagnet, a high magnetic flux is available for deflection of the electron beam. The electrical power required for effecting a specific deflection of the electron beam is therefore only slight. This results in only a small amount of dissipated heat arising in conjunction with the deflection of the electron beam.

The risk of undesired defocusing phenomena of the electron beam occurring is minimized in an embodiment of the invention, wherein the electron beam passes between the legs at a distance from the ends of the legs, since the magnetic field generated by the electromagnet exhibits high homogeneity in this region.

In another embodiment of the invention, each leg have a pole shoe at its end with a pole surface. The respective pole surfaces being disposed opposite one another and between which the electron beam passes. The risk of undesired defocusing phenomena of the electron beam is further reduced because of the high homogeneity of the magnetic field present between the pole shoes. The dissipated heat arising in conjunction with the deflection of the electron beam, moreover, is especially slight since the largest magnetic flux is present between the pole shoes.

In order to assure an undisturbed formation of the magnetic field, in a further embodiment of the invention the vacuum housing is formed of a non-magnetic material, at least in that region in which the legs extend through the walls of the vacuum housing into the interior thereof.

In order to prevent the material of the yoke from losing its ferromagnetic properties in view of the considerable temperatures present in the inside of the X-ray tube under certain circumstances, a diaphragm having a through-opening for the electron beam is provided between the anode and the electromagnet as a heat shield, in another embodiment of the invention.

DESCRIPTION OF THE PREFERRED EMBODIMENTS

Figure 1:
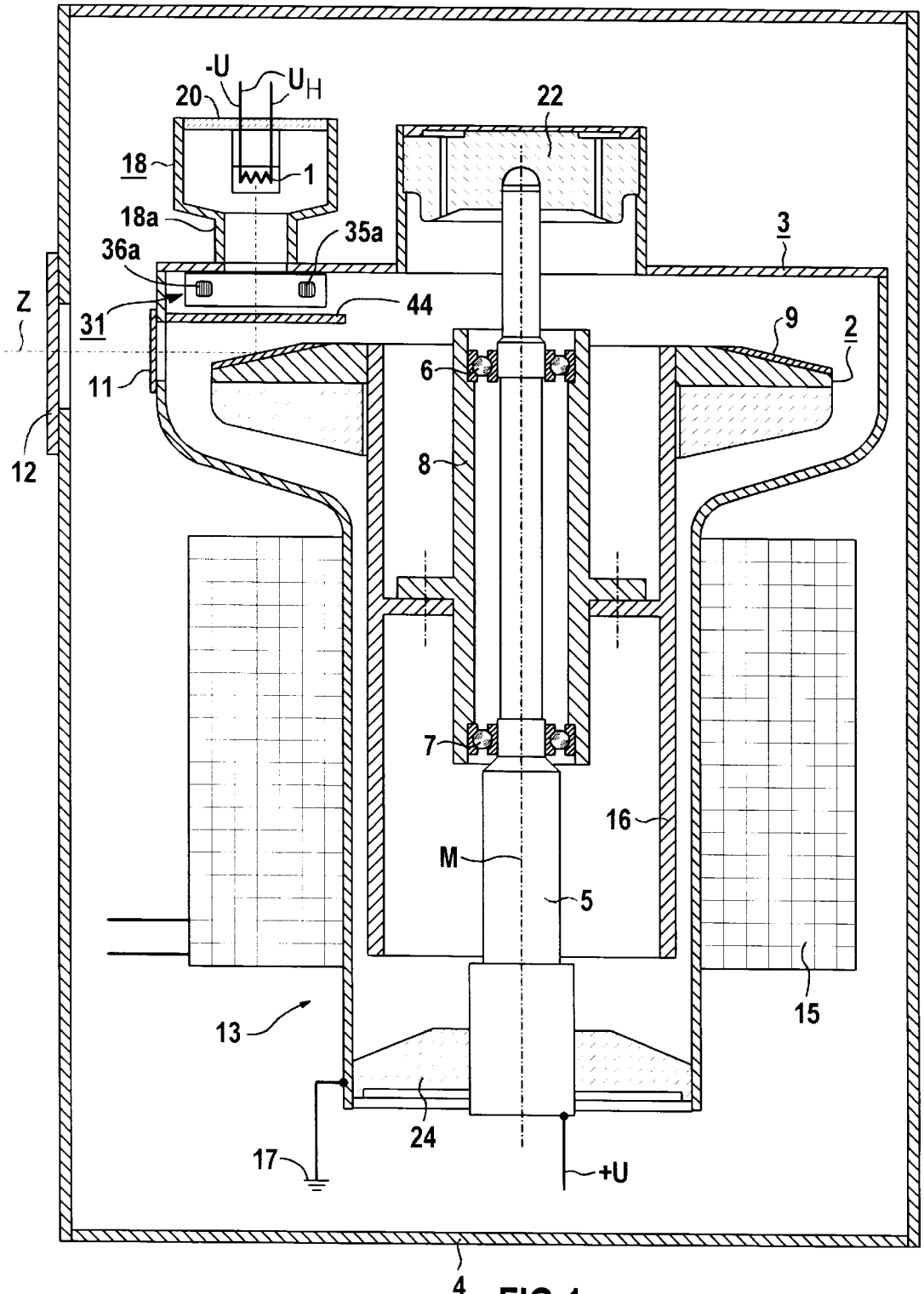
FIG. 1 illustrates an inventive X-ray tube shown schematically in a longitudinal section.

The X-ray tube according to FIG. 1 has a stationary cathode 1 and a rotating anode, generally referenced 2, that are arranged in a vacuum-tight, evacuated vacuum housing 3 that is in turn contained in a protective housing 4 filled with an electrically insulating, fluid coolant, for example insulating oil. The rotating anode 2 is rotatably mounted with two roller bearings 6, 7 and a bearing sleeve 8 on a stationary shaft 5 in the vacuum housing 3.

The rotating anode 2, which is rotationally symmetrically fashioned relative to the center axis M of the shaft 5, has a surface 9 provided, for example, with a layer of a tungsten-rhenium alloy onto which an electron beam 10 emanating from the cathode 1 is incident at a focal spot for generating X-ray. (In FIGS. 1 and 3, only the center axis of the electron beam 10 is shown, by a dashed line.) The corresponding useful X-ray beam, only the central ray Z thereof being shown in FIG. 1, emerges through beam exit windows 11 and 12 provided in the vacuum housing 3 and the protective housing 4 and arranged in alignment with one another.

An electric motor fashioned as a squirrel-cage motor and generally referenced 13 is provided driving the rotating anode 2, this motor 13 having a stator 15 on the exterior of the vacuum housing 3 and a rotor 16 that is located inside the vacuum housing 3 and is co-rotatably connected to the rotating anode 2.

A funnel-shaped housing section 18, which is connected to the rest of the vacuum housing 3 via a shaft-shaped housing part 18*a*, is attached to the vacuum housing 3

(which is at ground potential 17) and that, except for an insulator 20 carrying the cathode 1 and two insulators 22 and 24 accepting the shaft 5, is fashioned of metallic material. The cathode 1 is attached to the funnel-shaped housing section 18 with the insulator 20. The cathode 1 is thus located in a special chamber of the vacuum housing 3 that is connected thereto via the shaft-shaped housing part 18*a*.

The positive high-voltage +U for the rotating anode is supplied to the anode 2 via the shaft 5 and a terminal that is accepted vacuum-tight in the insulator 24. The tube current thus flows across the roller bearings 6 and 7.

As can be seen from the schematic illustration of FIG. 1, the negative high-voltage −U is at one terminal of the cathode 1. The filament voltage $U_H$ is across the two terminals of the cathode 1. The lines leading to the cathode 1, the shaft 5, the vacuum housing 3 and the stator 15 are in communication with a voltage supply (not shown) of a known type located outside the protective housing 4 that supplies the voltages required for the operation of the X-ray tube. As is clear from the above description the X-ray tube according to FIG. 1 is of the two-pole type.

Figure 2:
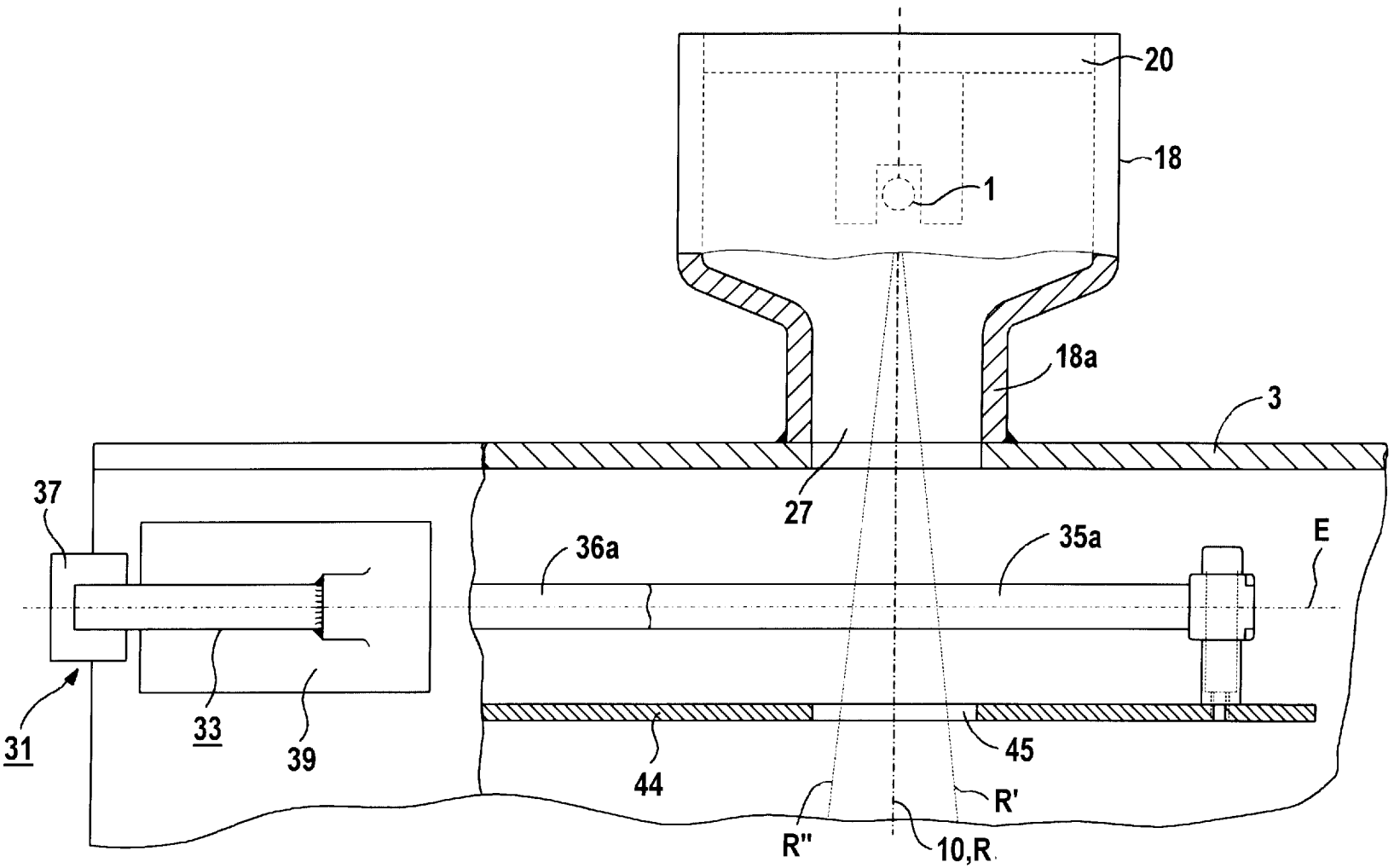
FIG. 2 is an illustration of a portion of the X-ray tube of FIG. 1 in a section along the line II—II in FIG. 3.

As can be seem in FIG. 2, the electron beam 10 emanating from the cathode 1 passes through the shaft-shaped housing part 18*a* as it propagates to the rotating anode 2. The shaft-shaped housing part 18*a* thus limits a diaphragm opening 27, the dimensions thereof being selected such that the opening 27 does not significantly exceed the dimensions required for an unimpeded passage of the electron beam 10.

An electromagnet 31, schematically indicated in FIG. 1, is also provided, which generates a magnetic deflection field for the electron beam 10 that deflects the electron beam 10 perpendicularly to the plane of the drawing in FIG. 1.

Figure 3:
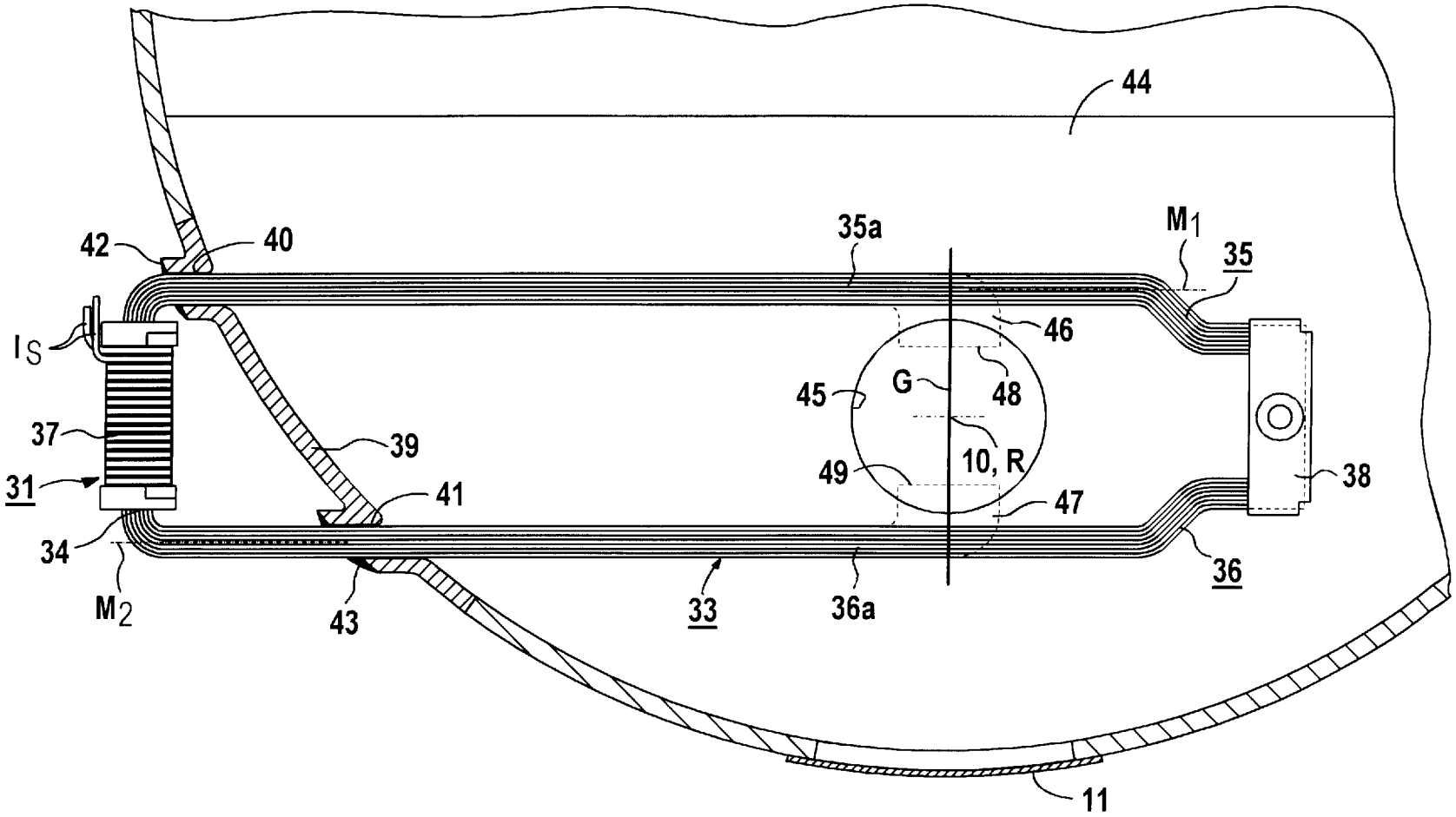
FIG. 3 is an illustration of a portion of the X-ray tube of FIG. 1 in a section along the line III—III in FIG. 2.

As shown in FIGS. 2 and 3, the electromagnet 31 has a U-shaped yoke 33 with two legs 35, 36 connected to one another by a base section 34, and a winding 37 surrounding the base section 34. The electromagnet 31 is arranged such that the winding 37 is located outside the vacuum housing 3, whereas the legs 35, 36 of the yoke 33 have the majority of their lengths situated inside the vacuum housing 3.

The legs 35, 36 of the electromagnet 31 extend through respective openings 40, 41 provided in an insert 39 and are connected to the insert 39 vacuum-tight, for example by solderings 42, 43. The insert 39 is in turn accepted in a corresponding opening of the vacuum housing 3 and is connected thereto vacuum-tight by soldering or welding.

A heat shield 44 that has an opening 45 for the passage of the electron beam 10 is located between the sections of the legs 35, 36 of the yoke 33 located in the inside of the vacuum housing 3 and the incident surface 9 of the rotating anode 2.

Overall, the arrangement is undertaken such that the electron beam 10 emanating from the cathode 1—after emerging from the shaft-shaped housing part 18*a*—proceeds between the legs 35, 36 of the yoke 33 of the electromagnet 31 and then proceeds through the opening 45 of the heat shield 44 to the incident surface 9 of the rotating anode 2.

At least the insert 39, but preferably the funnel-shaped housing part 18, the upper wall (in FIG. 1) of the vacuum housing 3 and the wall section of the vacuum housing 3 adjacent thereto and surrounding the rotating anode 3 (or, preferably all metallic parts of the vacuum housing 3) are formed of non-magnetic materials, for example stainless steel, in order to avoid degradation of the magnetic field generated with the electromagnet 31.

The free ends of the legs 35, 36 of the yoke 33 are fixed relative to the vacuum housing 3 with a clamp part 38 screwed to the heat shield 44 in the illustrated exemplary embodiment.

As indicated with broken lines in FIG. 3, the legs 35, 36 of the yoke 33 can be fashioned so as to have respective pole shoes 46, 47 lying opposite one another between which the electron beam 10 passes. Since the electron beam 10 is then located in the region of the largest field strength of the magnetic field of the electromagnet 31, an even further reduction is achieved for the electrical power required for a specific deflection of the electron beam 10. In order to be able to achieve pole shoes 46, 47 of adequate width, preferably the layer planes of the sheet metal lamellae forming the yoke 33 are offset by 90° relative to the direction shown with solid lines in FIGS. 2 and 3.

The winding 37 of the electromagnet 31 has terminals $I_S$ in communication with a current source (not shown) that allows a current to flow through the winding 37 during operation of the X-ray tube. When the current flowing through the winding 37 is a direct constant current, the electron beam is statically deflected, so that the static position of the focal spot can be adjusted. Given employment of the X-ray tube in a computed tomography apparatus, for example, it is thus possible to adjust the position of the focal spot relative to the rotational center of the gantry of the computed tomography apparatus and relative to the radiation detector attached to the gantry and lying opposite the X-ray tube. When a periodic deflection of the electron beam 10 is desired, the current supplied by the deflection circuit has, for example, a sawtooth or delta curve.

The yoke 33 is constructed in a known way of thin sheet metal lamellae and is shaped such that the legs 35, 36 respectively have sections 35*a*, 36*a* whose center axes $M_1$, $M_2$ proceed substantially parallel to one another and thus lie in a common plane E. The two straight-line sections 35*a*, 36*a* of the legs 35, 36 in the described exemplary embodiment have a length L that extends beyond the diaphragm opening 27 and the opening 45 in the direction of the center axes $M_1$, $M_2$ of the sections 35*a*, 36*a* of the legs 35, 36.

It is self-evident that, after being worked (cutting and bending), the sheet metal lamellae must be annealed in order to reverse the structural changes caused by the processing so as to avoid degrading the magnetization properties of their material.

The electromagnet 31 is connected such to the vacuum housing 3 such that the main propagation direction (shown with broken lines) of the electron beam 10 proceeds substantially at a right angle to the plane E containing the center axes $M_1$, $M_2$ of the sections 35*a*, 36*a*, as can be seen from FIG. 1 in combination with FIGS. 2 and 3, whereby the paths of the electron beam 10 for the two limit (extreme) positions obtainable by the deflection of the electron beam 10 are also shown dotted in FIG. 3, and referenced R' and R".

The electromagnet 31 also is arranged so that the electron beam 10 intersects a straight line G that intersects the main propagation direction of the electron beam 10 and the center axes $M_1$, $M_2$ of the sections 35*a*, 36*a* of the legs 35, 36 substantially a right angle at least essentially in the middle.

As a result of the described fashioning of the electromagnet 31, the magnetic field thereof is symmetrical relative to the plane E containing the center axes $M_1$, $M_2$ of the sections 35*a*, 36*a* of the legs 35, 36. This and the described arrangement of the electromagnet 31 relative to the vacuum housing 3 result in a substantially complete cancelling of defocusing phenomena that arise when the electron beam 10 passes through the part of the magnetic field located at the one side of the plane E on its way to the rotating anode 2, when the electron beam then proceeds through the part of the magnetic field lying on the other side of the plane E.

The described arrangement of the electromagnet 31 also allows the legs 35, 36 of the yoke 33 to be situated very close to the electron beam 10, and thus only slight power is required for the deflection of the electron beam 10. Moreover, the dissipated power of the electromagnet 31 can be unproblematically transferred to the coolant situated in the protective housing 4.

The two ends of the legs 35, 36 of the yoke 33, moreover, are angled toward one another in the region of their free ends in order to avoid an unnecessarily large stray field.

It is self-evident that the size of the deflection of the electron beam 10 with the electromagnet 31 is taken into consideration in the dimensioning of the shaft-shaped housing part 18*a*, and thus in the dimensioning of the diaphragm opening 27 as well as of the opening 45 of the heat shield 44.

Since the vacuum housing 3 is at ground potential, and thus at a more positive potential than the cathode 1, a large part of the electrons back-scattered from the rotating anode 2 is captured by the heat shield 44 and the regions of the vacuum housing 3 limiting the diaphragm opening 27 and adjacent thereto. Apart from its conventional function, the vacuum housing 3 thus also fulfills the function of a diaphragm for reducing the extra-focal radiation, particularly in the region of the heat shield 44 and of the housing part 18*a*.

As noted above, the X-ray tube shown in FIG. 1 is of a type known as a two-pole X-ray tube. The inventive X-ray tube, however, also can be implemented as a single-pole X-ray tube. The vacuum housing 3 and the rotating anode 2 then are at the same potential, namely ground potential 17, whereas the cathode 1 is at the negative high-voltage –U. In order to allow the rotating anode 2 and the vacuum housing 3 both to be at ground potential 17, an end shield formed of an electrically conductive material can be provided, for example, instead of the insulator 22 and/or the insulator 24, so that there is an electrically conductive connection between the rotating anode 2 and the vacuum housing 3. Alternatively or additionally, the shaft 5 can be connected to ground potential 17.

Although the invention was explained on the basis of an X-ray tube with a rotating anode seated in rolling bearings, it can also be employed in X-ray tubes having a rotating anode seated in plain bearings, X-ray tubes of the type known as rotating tubes (the vacuum tube rotates together with the anode) and in X-ray tubes having a fixed anode.

Although modifications and changes may be suggested by those skilled in the art, it is the intention of the inventor to embody within the patent warranted hereon all changes and modifications as reasonably and properly come within the scope of his contribution to the art.

I claim as my invention:

1. An X-ray tube comprising:

a vacuum housing;

a cathode and an anode disposed in said vacuum housing, said cathode emitting an electron beam which propagates along an electron beam path to said anode;

an electromagnet disposed for interacting with said electron beam in said electron beam path for deflecting said electron beam;

said electromagnet comprising a yoke having two legs and a base section connecting said two legs and a winding around said base section; and said base section with said winding thereon being disposed outside of said vacuum housing, and said legs extending into an interior of said vacuum housing and being disposed so that said path of said electron beam proceeds between said legs.

2. An X-ray tube as claimed in claim 1 wherein said legs have respective ends disposed in the interior of said vacuum housing, and wherein said legs are disposed so that said path of said electron beam proceeds between said legs at a distance from the respective ends of the legs.

3. An X-ray tube as claimed in claim 1 wherein each of said legs has a pole shoe and wherein each pole shoe has a pole surface, said legs being disposed with the respective pole surfaces of the respective pole shoes disposed opposite each other with said path of said electron beam proceeding between said pole surfaces.

4. An X-ray tube as claimed in claim 1 wherein said vacuum housing has a wall with a region through which said legs of said yoke of said electromagnet extend, and wherein at least said region of said wall of said vacuum housing is comprised of non-magnetic material.

5. An X-ray tube as claimed in claim 1 further comprising a diaphragm having a diaphragm opening mounted in the interior of said vacuum housing between said anode and said electromagnet, with said path of said electron beam proceeding through said diaphragm opening of said diaphragm.

* * * * *